United States Patent [19]

Essler

[11] 4,316,164

[45] Feb. 16, 1982

[54] ELECTROMAGNETIC RELAY WITH SNAP-IN YOKE

[75] Inventor: Richard Essler, Munich, Fed. Rep. of Germany

[73] Assignee: Siemens Aktiengesellschaft, Berlin & Munich, Fed. Rep. of Germany

[21] Appl. No.: 121,423

[22] Filed: Feb. 14, 1980

[30] Foreign Application Priority Data

Mar. 30, 1979 [DE] Fed. Rep. of Germany ... 7909135[U]

[51] Int. Cl.[3] ..... H01H 50/02

[52] U.S. Cl. ..... 335/202; 335/128

[58] Field of Search ..... 335/202, 203, 135, 128, 335/133

[56] References Cited

U.S. PATENT DOCUMENTS 3,848,205 11/1974 Schantz et al. ..... 335/128

FOREIGN PATENT DOCUMENTS 278509 1/1979 Fed. Rep. of Germany .

*Primary Examiner*—Harold Broome

*Attorney, Agent, or Firm*—Hill, Van Santen, Steadman, Chiara & Simpson

[57] ABSTRACT

An electromagnetic relay having a magnetic system actuatable to displace a movable contact element to make and break with at least one fixed contact element is provided with an insertable member of insulating material which has a vertical wall dividing the interior of the relay into essentially non-communicating portions respectively containing the contact elements and the magnetic system. The portion containing the magnetic system is further surrounded by opposed parallel lateral walls which, with the vertical wall, provide an insulating enclosure for the magnetic system. The magnetic system includes a yoke which has projections thereon slidably received in vertical grooves in the lateral walls. The lateral walls are sufficiently expandable such that during assembly the yoke can be inserted in the grooves in a snap-in manner. The yoke is attached to the magnetic coil so that no further structure is required to support the magnetic system.

5 Claims, 3 Drawing Figures

ELECTROMAGNETIC RELAY WITH SNAP-IN YOKE

BACKGROUND OF THE INVENTION

1. Field of the Invention

The present invention relates to electromagnetic relays, and in particular such relays utilizing a magnetic coil with a yoke-and-armature assembly to displace a movable contact to make and break electrical connections with at least one fixed contact.

2. Description of the Prior Art

Electromagnetic relays utilizing a yoke-and-armature assembly to transmit movement of a magnetic coil plunger to one or more movable contacts are known in the art.

A relay of the above-described type is disclosed in German Offenlegungsschrift No. 27 28 509. As described therein, the relay has an insertable insulating member which has a vertical dividing wall which separates the interior of the relay into portions respectively containing the contact elements and the magnetic system. This structure is to overcome the problem in the art of flash over or arcing through leakage paths between the contact elements and any connection to ground, such as through the magnetic system. The magnetic system in the above patent document is supported by the insertable insulating member by means of a flange on the magnetic coil which engages the insulating member in detent fashion. The movable yoke leg is guided in grooves in parallel lateral walls on either side of the insulating member.

A problem of the above structure and method of mounting the magnetic system within the relay is that parts must be manufactured and assembled in close tolerance so that both the flange supporting the magnetic system and the yoke leg fit into the corresponding receiving grooves in the insulating member. Because the magnetic system is generally assembled in a separate step and subsequently inserted into the insulating member, care must be taken to assemble the magnetic system so as to precisely coordinate with the insulating member dimensions. This requirement results in increased production cost and time as well as some parts which must be either reworked or discarded because the parts have dimensions outside of the acceptable tolerance range.

SUMMARY OF THE INVENTION

It is an object of the present invention to provide a connection between an insertable insulating support member for an electromagnetic relay and the magnetic system for the relay which allows insertion of the magnetic system into the insulating member in one step which does not require alignment of parts of the magnetic system within a tolerance range.

The above object is inventively achieved in an electromagnetic relay in which the magnetic system is guided and supported by an insertable insulating member solely by means of grooves on lateral walls of the insulating member which receive projections extending from a leg of the yoke utilized in the magnetic system.

The present invention is an electromagnetic relay which has an insertable insulating member which has a vertical dividing wall which separates the interior of the relay into two essentially non-communicating portions respectively containing the contact elements and the magnetic system of the relay. The presence of the vertical wall substantially minimizes flash over or arcing between the contact elements and the magnetic system. The insulating member is further provided with opposed lateral parallel walls which extend perpendicularly from the vertical wall and surround a portion of the magnetic system. The magnetic system utilizes a conventional yoke-and-armature assembly to transmit movement of the armature to one of the contact elements via an actuation element.

In accordance with the present invention, the lateral walls are provided with vertical grooves on an interior side thereof which slidably receive a number of projections extending from the sides of a downwardly extending leg of the yoke. At least one of the projections further extends into a recess or window in one of the lateral walls to position and support the entire magnetic system. No other supporting structure is required for the coil, so that once the yoke is positioned in the grooves in the lateral walls, no further alignment of any portion of the magnetic system with a corresponding portion of the insulating member is required, thus simplifying assembly of the magnetic system into the insulating member, as well as simplifying assembly of the magnetic system itself.

The projection which extends into the recess is further provided with a beveled edge to ease sliding of the yoke into position along a corner which is formed by the recess, thereby preventing chipping or cracking of the insulating member during assembly.

The grooves in the lateral walls may further be provided with deformable ribs to insure a snug fit of the yoke leg therein, yet still allowing slidable movement of the yoke leg within the groove.

DESCRIPTION OF THE PREFERRED EMBODIMENTS

Figure 1:
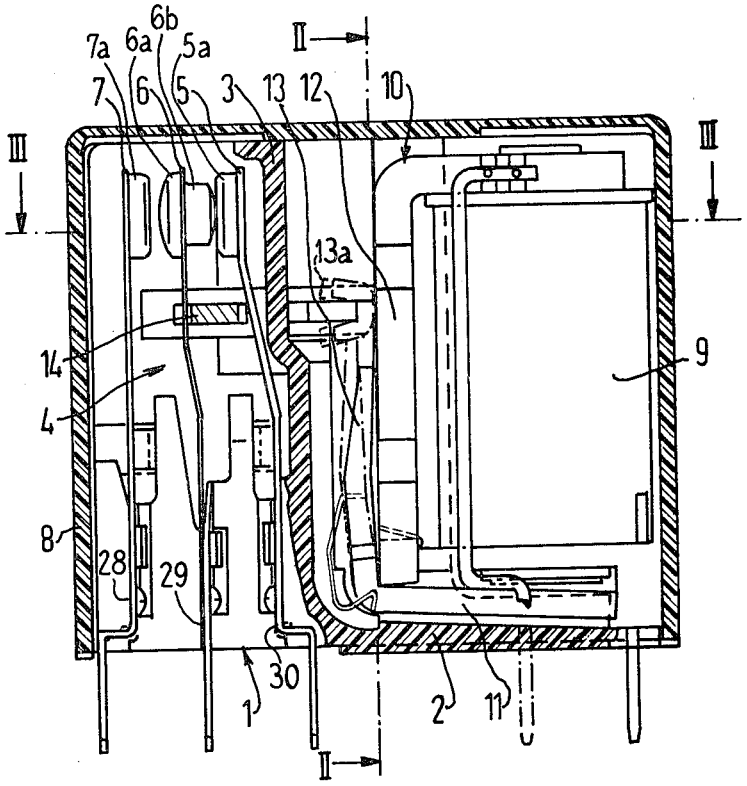
FIG. 1 is a side view in section of an electromagnetic relay constructed in accordance with the principles of the present invention.

An electromagnetic relay constructed in accordance with the principles of the present invention is shown in a side sectional view in FIG. 1. The relay consists of an insertable insulating member generally referenced at 1 which has a base portion 2 and a vertical dividing wall 3. The vertical dividing wall 3 separates the interior of the relay into a first portion 4 which contains contact elements 5, 6 and 7 and a second portion which contains a magnetic system consisting of an electromagnetic coil and plunger 9, a yoke 10, and an armature 13. The armature 13 is movable from the position shown at the solid lines in FIG. 1 to the position 13*a* represented by the dashed lines in response to current in the coil 9.

Such movement is transmitted to the contact elements by a slidable member 14. The slidable member 14 may be received in a groove (not shown) in rear walls 27 and 16, as viewed in FIG. 3, so as to retain the non-communicating nature of the interior portions of the relay as much as possible. Any other method of transmitting movement through the vertical wall 3 may be utilized in connection with the inventive concept disclosed herein.

In the embodiment shown in FIG. 1, such movement is transmitted to a central movable contact element 6 disposed between two fixed contact elements 5 and 7. The contact element 6 is displaceable by the slidable member 14 to abut a contact portion *6a* thereof with a contact portion *7a* of the contact element 7, as well as to abut a second contact portion *6b* with a contact portion *5a* of the fixed contact element 5. The contact elements 5, 6 and 7 are respectively anchored in the insulating member 1 in notches 30, 29 and 28 by any suitable means.

Other contact arrangements as well as anchoring methods may be utilized as are known in the art in combination with the inventive concept herein of positioning and supporting the magnetic system within the relay. All interior elements of the relay are covered with a protective cap 8.

Figure 2:
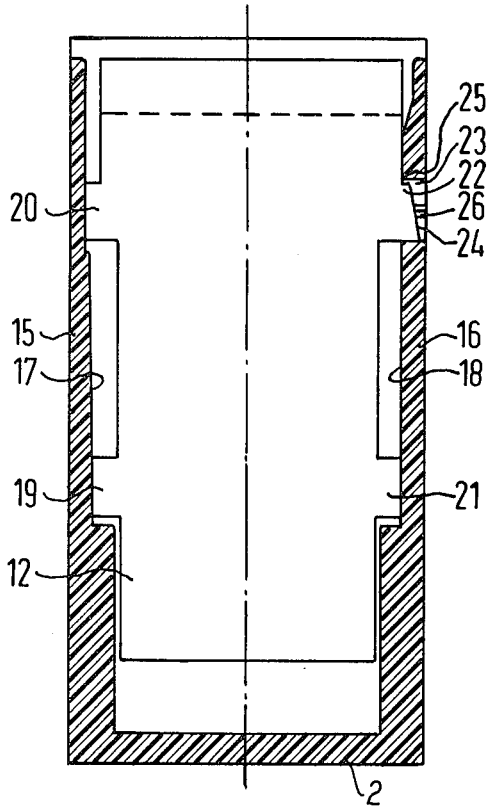
FIG. 2 is a sectional view taken along line II—II of FIG. 1.
Figure 3:
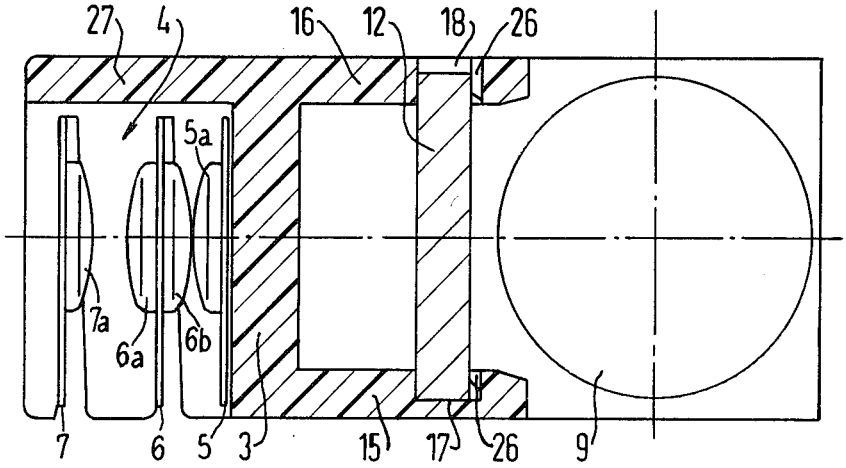
FIG. 3 is a sectional view taken along line III—III of FIG. 1.

As best shown in FIGS. 2 and 3, the insulating member 1 is further provided with opposed parallel lateral walls 15 and 16 which extend in orthogonal relationship with respect to the vertical wall 3 and the base portion 2. The lateral walls 15 and 16 surround a portion of the magnetic system, namely the yoke 10 and the armature 13, as well as a portion of the coil 9. The walls 15 and 16 thus serve as further insulation to prevent flash over or arcing between the portions of the interior of the relay.

The walls 15 and 16 further serve to support and position the entire magnetic system by means of vertical grooves 17 and 18 respectively disposed within the lateral walls 15 and 16. The grooves 17 and 18 are in registry to receive a downwardly extending yoke leg 12 of the yoke 10. The leg 12 is provided with any number of projections which extend into the grooves 17 and 18. In the embodiment shown in FIG. 2, four such projections referenced at 19, 20, 21 and 22 are utilized, however a different number may be employed as conditions warrant without departing from the inventive concept disclosed herein.

The grooves are dimensioned to retain the yoke leg 12 in substantially vertical position once the leg 12 is inserted therein, however, limited vertical sliding movement is permitted within the grooves 17 and 18. This movement is sufficient to transmit the movement of the plunger in the coil 9 to the armature 13 to displace the contact element 6.

Assembly of the yoke leg 12 and the insulating member 1 is accomplished by slightly expanding the lateral walls 15 and 16 to insert the projections into the grooves 17 and 18. As further shown in FIG. 2, a recess or window 23 is provided in the groove 18 and the projection 22 extends slightly further than the other projections to be received in the recess 23. As the walls 15 and 16 are expanded, a beveled edge 24 of the projection 22 slides along the corner 25 formed by the recess 23 so as to prevent chipping or otherwise breaking the wall 16. As soon as the projection 22 is aligned with and received in the recess 23, the lateral walls 15 and 16 will automatically return to their initial positions, providing a snap-in connection for the leg 12 within the insulating member 1. This positions the entire magnetic system without any further supporting structure.

Additionally, each groove 17 and 18 is provided with a lateral rib 26 which is deformable to maintain the yoke leg 12 in substantially vertical position, yet allows sliding engagement of the yoke leg 12 within the grooves 17 and 18.

As a further protection against arcing or flash over from the portion 4 through the recess 23, an additional lateral wall 27, shown in FIG. 3, is provided which is generally aligned with the wall 16 and is also in orthogonal relation to the vertical wall 3 and the base portion 2. The wall 27 provides insulation to eliminate or substantially minimize any leakage paths which may result by the presence of the recess 23.

Although modifications and changes may be suggested by those skilled in the art, it is the intention of the inventor to embody within the patent warranted hereon all changes and modifications as reasonably and properly come within the scope of his contribution to the art.

I claim as my invention:

1. In an electromagnetic relay having a magnetic system energizable in response to a received signal, a yoke-and-armature assembly for transmitting movement of said armature to a movable contact element to make and break electrical connections between said movable contact element and at least one fixed contact element, and an insertable insulating member having a base which forms the bottom of said relay and a vertical wall disposed between said magnetic system and said contacts which divides the interior of said relay into essentially non-communicating portions to prevent arcing therebetween, the improvement of:

a pair of opposed lateral parallel walls disposed in orthogonal relation to said vertical wall and said base which partially surround said magnetic system, at least one of said lateral walls having at least one recess therein extending through said one of said walls; and a yoke for said yoke-and-armature assembly having a downwardly extending generally vertical leg, at least one projection extending from a side of said leg, said projection in registry with and received in said recess in said lateral wall to position and support said leg, said recess having greater vertical dimensions than said projection received therein to permit limited vertical movement of said projection within said recess, said yoke connected to said plunger such that positioning of said projection within said recess positions the entire magnetic system within said relay.

2. The relay of claim 1 wherein each of said lateral walls has a vertical groove therein, said grooves being in registry and one of said grooves containing said recess, and a plurality of additional projections on said yoke leg which are received in said grooves to further guide said yoke leg for vertical movement within said grooves.

3. The relay of claim 1 wherein said one projection terminates in a beveled edge, said beveled edge being slanted in a direction to ride against a corner of said one of said lateral walls formed by said recess, as said yoke leg and said one projection are positioned therein.

4. The relay of claim 2 wherein each of said vertical grooves is provided with a deformable horizontal rib which abuts said projections to substantially fix the vertical position of said projections and said yoke leg within said grooves and permit sliding engagement of said projections with said ribs.

5. The relay of claim 1 wherein at least one additional lateral wall is provided in orthogonal relation to said vertical dividing wall and said base which extends into said portion of said interior of said relay containing said contacts, said additional lateral wall being disposed in alignment with one of said lateral walls containing said recess to prevent arcing from said portion of said relay containing said contacts to said portion of said relay containing said magnetic system through said recess.

* * * * *